United States Patent [19]

Kukuck

[11] Patent Number: 4,595,494

[45] Date of Patent: Jun. 17, 1986

[54] APPARATUS FOR SEPARATING FERROMAGNETIC PARTICLES FROM A SLURRY

[75] Inventor: Karl-Heinz Kukuck, Ennigerloh, Fed. Rep. of Germany

[73] Assignee: Krupp Polysius AG, Beckum, Fed. Rep. of Germany

[21] Appl. No.: 650,258

[22] Filed: Sep. 13, 1984

[30] Foreign Application Priority Data

Oct. 5, 1983 [DE] Fed. Rep. of Germany ..... 3336255

[51] Int. Cl.[4] ..... B03C 1/14

[52] U.S. Cl. ..... 209/224; 209/232; 210/222; 335/278; 335/301

[58] Field of Search ..... 210/222, 223; 209/232, 209/223.1, 224, 214, 215, 223.2, 225; 335/278, 204, 304, 301, 294, 300

[56] References Cited

U.S. PATENT DOCUMENTS

| | | | |
|---|---|---|---|
| 263,131 | 8/1882 | Edison | 210/222 |
| 731,045 | 6/1903 | Gates | 209/232 |
| 1,245,717 | 11/1917 | Henderson | 209/224 |
| 1,390,688 | 9/1921 | Ellis | 209/232 |
| 2,056,426 | 10/1936 | Frantz | 209/214 |
| 3,375,926 | 4/1968 | Watts | 210/222 |
| 3,768,233 | 10/1973 | Mateson | 210/222 |
| 4,042,492 | 8/1977 | Decker | 209/232 |
| 4,166,788 | 9/1979 | Druz et al. | 209/232 |
| 4,326,954 | 4/1982 | Shroyer | 210/222 |

FOREIGN PATENT DOCUMENTS

| | | | |
|---|---|---|---|
| 8002280 | 10/1980 | European Pat. Off. | 210/222 |
| 0058946 | 5/1979 | Japan | 210/222 |
| 74456 | 11/1953 | Netherlands | 210/222 |
| 227330 | 2/1969 | U.S.S.R. | 210/222 |
| 0624650 | 9/1978 | U.S.S.R. | 209/223 R |

*Primary Examiner*—Frank W. Lutter
*Assistant Examiner*—Wm. Bond
*Attorney, Agent, or Firm*—Learman & McCulloch

[57] ABSTRACT

The invention relates to apparatus for separating ferromagnetic particles from a slurry, in which the slurry passes through a tunnel-shaped channel which is surrounded by a magnet coil the iron yoke of which is constructed asymmetrically in such a way that the magnetic field strength in the channel increases from the top towards the bottom.

9 Claims, 6 Drawing Figures

4d
4
4b
1
4a
3
7
4c
II
II
4d
3
4
6
5
8
7
III
III
1
4c
4f
6
8
H1
H2
K
I
I
4
2
3
4e
5
1
7'
V
V
3
4
1

APPARATUS FOR SEPARATING FERROMAGNETIC PARTICLES FROM A SLURRY

This invention relates to apparatus for use in the magnetic separation of magnetically permeable particles from a flowing slurry.

BACKGROUND OF THE INVENTION

A slurry often contains ferromagnetic particles in quantities of a few g/t of the material delivered. These are residual constituents from previous magnetic separation stages, traces of strongly magnetic minerals, or dust from preceding treatments.

It is highly probable that ferromagnetic particles which enter a strong field separator with the material delivered are held back in the induction body which is constructed as a matrix and accumulate there during the operating period until they clog the apparatus. Periodic cleaning during operation is difficult to carry out because the holding forces in a strong field separator cannot be reduced to zero, as a consequence of which there remains a magnetic field level which is high for ferromagnetic particles and consists of stray fields and residual magnetism.

An object of the invention, therefore, is to provide suitable apparatus for separating ferromagnetic particles from a slurry which is distinguished by a simple construction and a high degree of efficiency and is particularly suitable as a preliminary separator upstream from a strong field separator.

SUMMARY OF THE INVENTION

Apparatus for use in separating ferromagnetic particles from a slurry comprises an annular coil forming and encircling a tunnel-shaped channel through which the slurry flows. The coil enables the formation of a magnetic field which passes through the channel. The coil is encircled by a magnetic housing of asymmetric construction which causes the strength of the magnetic field in the channel to increase in a vertically downward direction.

THE DRAWINGS

Preferred embodiments of the invention are shown in the accompanying drawings, in which.

DETAILED DESCRIPTION

Figures 1, 2, 3, 4:
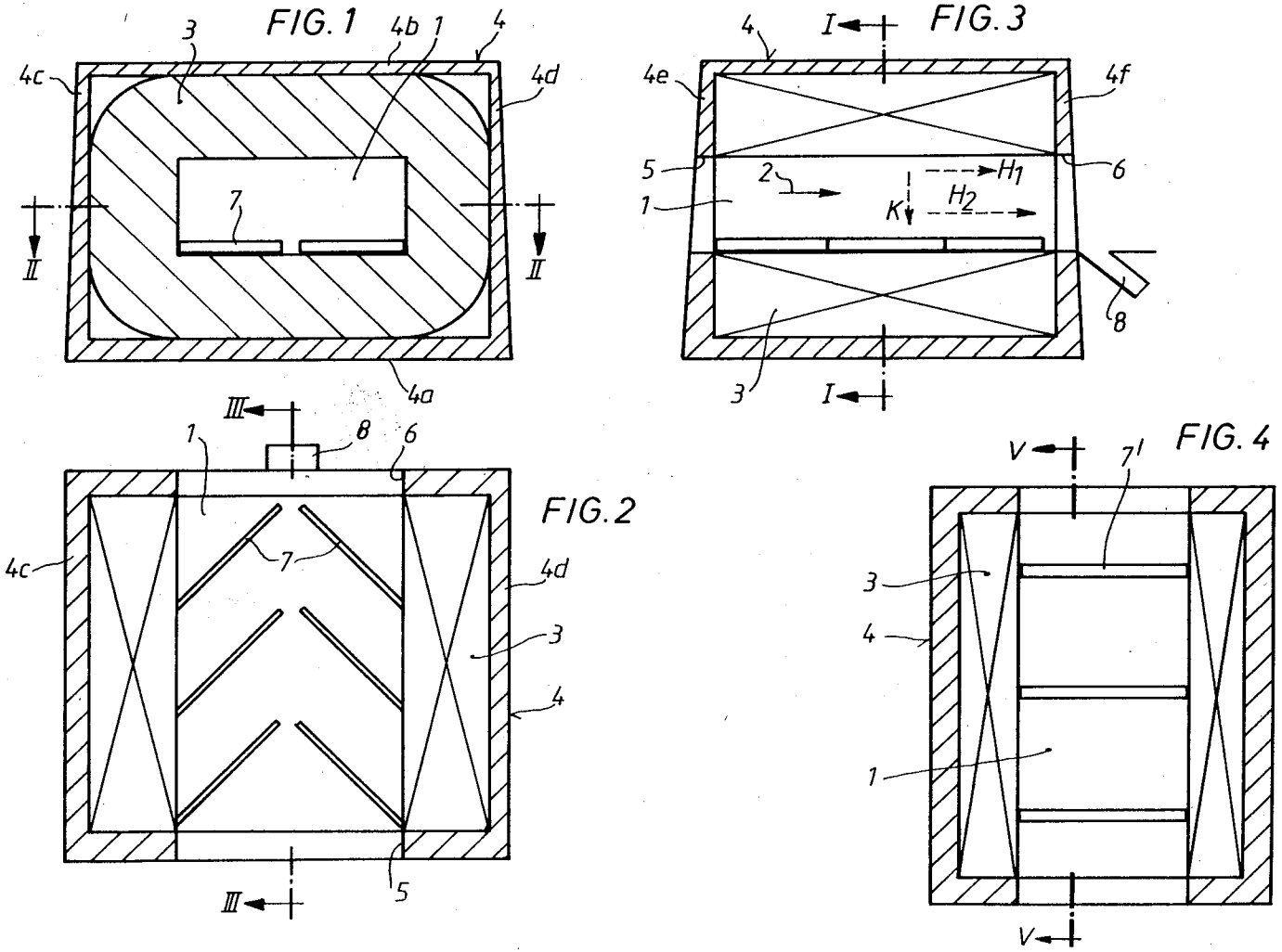
FIG. 1 is a vertical cross-section taken on the line I—I of FIG. 3 and illustrates a first embodiment of the invention.
FIG. 2 is a horizontal longitudinal section taken on the line II—II of FIG. 1.
FIG. 3 is a vertical longitudinal section taken along the line III—III of FIG. 2.
FIG. 4 is a vertical longitudinal section (corresponding to FIG. 2) through a second embodiment of the invention.

The apparatus shown in FIGS. 1-3 for separating ferromagnetic particles from a slurry contains a tunnel-shaped channel 1 which is arranged horizontally and through which the slurry flows longitudinally along a path in the direction indicated by the arrow 2. The channel 1 is encircled by an annular magnet coil 3 which produces a magnetic field that passes through the channel 1 in the longitudinal direction.

The magnet coil 3 is encircled by an annular continuous iron yoke or housing 4 which is of asymmetric construction. As can be seen from FIG. 1, the part 4*a* of the iron yoke 4 located below the channel 1 has a greater cross-sectional area than the part 4*b* of the iron ground located above the channel 1. The cross-section of the two lateral parts 4*c*, 4*d* increases towards the bottom. The same applies to the cross-section of the end parts 4*e* and 4*f* of the iron ground. Windows 5, 6 are provided at both ends of the iron yoke in the region of the channel 1.

As a result of the asymmetric construction of the iron yoke 4 the magnetic field strength in the channel 1 increases from the top towards the bottom, as viewed in a vertical cross-section. This is indicated schematically in FIG. 3 by the two field strength arrows $H_1$ and $H_2$.

In such a non-homogeneous magnetic field a magnetic gradient force is produced which causes an iron or other magnetically permeable body to be drawn into the stronger field. As a result a force K (cf. FIG. 3) which is directed towards the base of the channel 1 acts on the ferromagnetic particles contained in a slurry flowing along the channel.

In the embodiment according to FIGS. 1-3 strips 7 made from magnetic material are mounted on the base of the channel 1 and are arranged in two rows in V-formation at an angle of 30° to 60°, preferably approximately 45°, to the longitudinal direction of the channel 1 in such a way that a flow channel which leads to an outlet 8 remains between the two rows. The magnetic strength of the strips is relatively weak compared to that of the yoke 4.

As they flow through the tunnel-shaped channel 1 the ferromagnetic particles are drawn to the bottom and are deposited on the strips 7 which are arranged in V-formation. They are then carried by the force of the flow towards the centre and to the outlet 8. The ferromagnetic particles leave the separator with a proportion of the slurry through the outlet 8.

Figure 5:
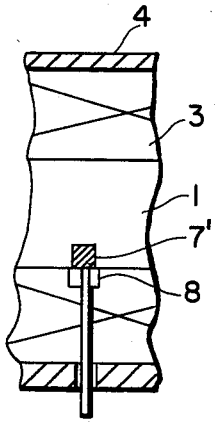
FIG. 5 is a sectional view taken on the line V—V o FIG. 4.

In the further embodiment illustrated in FIGS. 4 and 5 the strips 7' are arranged at right angles to the longitudinal direction of the channel 1 and extend over the whole breadth of the channel. The separated ferromagnetic particles are discharged intermittently by breaking the magnetic field and flushing the apparatus through with a washing fluid. For improved cleaning of the base the strips 7' can be vertically adjustable in slots 8 formed in the coil 3 and the yoke 4 so as to be capable of being lowered by means of handles 9.

Figure 6:
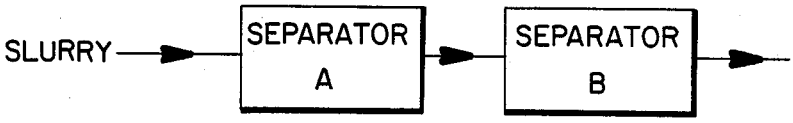
FIG. 6 is a diagrammatic view of a pair of separators arranged in tandem.

In the embodiment illustrated in FIG. 6 two magnetic separators A and B are arranged in tandum so that a slurry containing ferromagnetic particles flows in succession through each separator. The separators A and B correspond to any of those described previously herein but the downstream separator B preferably utilizes a stronger magnetic field than the upstream separator A.

I claim:

1. Apparatus for use in separating ferromagnetic particles from a slurry, said apparatus comprising a separator having an annular magnetic coil forming and encircling a substantially horizontal, tunnel-shaped channel through which the slurry flows, said coil enabling the production of a magnetic field which passes through the channel; and an annular, continuous, asymmetrical iron yoke encircling the magnetic coil and so arranged relatively thereto that the magnetic field strength in the channel increases from its top towards its bottom.

2. Apparatus according to claim 1 wherein that part of the iron yoke located below the channel has a greater cross-sectional area than that part of the iron yoke located above the channel, and wherein the cross-section of those parts of the iron ground on opposite sides of the channel increases in a direction towards the bottom of said ground.

3. Apparatus according to claim 1, wherein said separator occupies a position upstream from a stronger magnetic field separator.

4. Apparatus according to claim 1 including magnetically permeable strips positioned at the base of the channel.

5. Apparatus according to claim 4 wherein said strips are formed of relatively weak magnetic material compared to that forming said iron yoke.

6. Apparatus according to claim 4, characterized in that the strips are arranged at right angles to the direction of flow of said slurry and extend over the whole breadth of the channel.

7. Apparatus according to claim 4, characterized in that the strips are mounted in slots and can be lowered for facilitating cleaning of the channel.

8. Apparatus according to claim 4 wherein said strips are arranged in two rows in a V-formation in such manner as to form a flow channel between the two rows.

9. Apparatus according to claim 8 wherein said strips are arranged at an angle of 30° to 60° relative to the flow of said slurry.

* * * * *

UNITED STATES PATENT AND TRADEMARK OFFICE

CERTIFICATE OF CORRECTION

PATENT NO. : 4,595,494

DATED : June 17, 1986

INVENTOR(S) : Karl-Heinz Kukuck

It is certified that error appears in the above-identified patent and that said Letters Patent are hereby corrected as shown below:

Column 1, line 57, change "o" to -- of --.

Column 3, line 7, change "ground" to -- yoke--.

Column 3, lines bridging 10 and 11, change "separator" to -- yoke --.

Signed and Sealed this

*Ninth* Day of *September 1986*

[SEAL]

*Attest:*

DONALD J. QUIGG

*Attesting Officer*

*Commissioner of Patents and Trademarks*